US006049161A

United States Patent [19]

Lykowski

[11] Patent Number: 6,049,161

[45] Date of Patent: Apr. 11, 2000

[54] INSTALLATION CONFIGURATION FOR A SPARK PLUG

[75] Inventor: James D. Lykowski, Temprance, Mich.

[73] Assignee: Federal-Mogul World Wide, Inc., Southfield, Mich.

[21] Appl. No.: 09/168,147

[22] Filed: Oct. 8, 1998

[51] Int. Cl.[7] ..... F02M 57/06

[52] U.S. Cl. ..... 313/118; 313/143

[58] Field of Search ..... 313/118, 141, 313/443, 144, 145, 135; 123/169 R, 169 EL, 169 EC

[56] References Cited

U.S. PATENT DOCUMENTS

| | | | |
|---|---|---|---|
| 3,675,516 | 7/1972 | Knudsen et al. | 81/121 |
| 3,940,649 | 2/1976 | Berstler | 313/122 |
| 4,489,596 | 12/1984 | Linder et al. | 73/116 |
| 4,893,977 | 1/1990 | Tramezzani | 411/278 |
| 4,989,557 | 2/1991 | Penny | 123/169 EL |
| 5,697,334 | 12/1997 | Below | 123/169 R |

OTHER PUBLICATIONS

Kistler Information catalog; p. 4 Undated.

*Primary Examiner*—Vip Patel
*Assistant Examiner*—Todd Reed Hopper
*Attorney, Agent, or Firm*—Fish & Richardson P.C.

[57] ABSTRACT

A spark plug includes a ground electrode, a firing electrode, an insulator core, and an outer shell surrounding the insulator core. The outer shell has a threaded section for mounting the spark plug in a combustion engine and a splined section for installation of the spark plug. The splined section includes at least one spline having an outer surface and a corresponding castellation recessed from the outer surface.

25 Claims, 2 Drawing Sheets

INSTALLATION CONFIGURATION FOR A SPARK PLUG

The invention relates to installation of spark plugs.

BACKGROUND

A conventional spark plug includes an insulator core assembly and an outer shell having a hexagonal mounting section. A firing center electrode extends from the insulator core assembly and a ground electrode extends from the outer shell, with the electrodes being positioned to define a spark gap. When the spark plug is mounted in an engine, the spark gap is located in the combustion chamber of the engine.

The spark plug is installed in the head of a combustion engine by inserting the spark plug in a spark plug well of the head and then installing the spark plug in a threaded channel opening into the combustion chamber. The spark plug is tightened into the threaded channel by using, for example, a hexagonal socket placed around the hexagonal mounting section of the outer shell of the spark plug. The socket is positioned over the spark plug and surrounds the upper portion of the spark plug. The spark plug well has a larger diameter than the outer diameter of the socket so that the socket can be inserted into the spark plug well.

SUMMARY

In one general aspect, a spark plug includes a ground electrode, a firing electrode, an insulator core, and an outer shell surrounding the insulator core. The outer shell includes a threaded section for mounting the spark plug in a combustion engine and a splined section for installing the spark plug. The splined section includes at least one spline having an outer surface and a corresponding castellation recessed from the outer surface.

Embodiments may include one or more of the following features. For example, the castellation may include a back surface and a pair of edge surfaces. The back surface may be curved. An intersection of an edge surface and the back surface may define an angle of 90° or less. The splined section may include at least two splines and two castellations, and generally includes six splines and six castellations. A maximum outer diameter of the splined section, as measured between outer surfaces of the splines, may be approximately 16 mm. A base diameter of the splined section may be approximately 14 mm.

In another general aspect, a splined socket is provided for installing a splined spark plug. The splined socket includes at least one spline, an opening, a structure for connecting the socket to a socket wrench, and a shaft passing between the opening and the structure. The spline may extend from the shaft at the opening.

Embodiments may include one or more of the following features. For example, the splined socket may have six splines extending from the shaft at the opening. Each spline may include an inner surface, an outer surface, and a pair of edge surfaces. An intersection of an edge surface and the inner surface may define an angle of 90° or less. The intersections of the edge surfaces and the inner surface may define angles of 90° or less. A maximum outer diameter of the socket, measured from the outer surface of a spline, may be approximately 16 mm.

In another general aspect, a spark plug having a splined installation section may be installed in an engine by placing the spark plug in a spark plug well of the engine, placing a splined socket over the spark plug, engaging the splined socket with the splined installation section of the spark plug, and turning the socket to mount the spark plug in a threaded section of a head of the combustion engine. The splined socket has at least one spline and the splined installation section of the spark plug has at least one spline and a corresponding recessed castellation.

Embodiments may include one or more of the above or following features. For example, engaging the splined socket with the spark plug may include inserting splines of the splined socket into castellations of the splined installation section of the spark plug.

The use of splines offers the considerable advantage of permitting use of a socket having a smaller outer diameter than is required with a conventional spark plug having a similar diameter. This, in turn, permits the spark plug well of the head of a combustion engine to have a smaller diameter, which provides improved head strength and additional space for other functions.

Other features and advantages will be apparent from the following description, including the drawings, and from the claims.

DESCRIPTION

Figure 1:
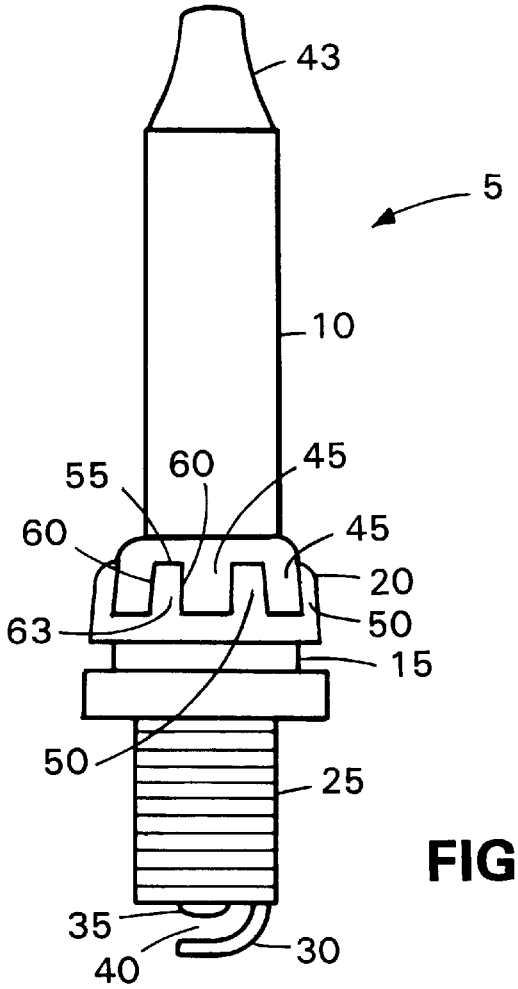
FIG. 1 is a cross sectional view of a spark plug having a splined installation section.

Referring to FIG. 1, a splined spark plug 5 includes an insulator core assembly 10 mounted in a splined outer shell 15. Outer shell 15 includes a splined installation section 20, a threaded section 25, and a ground electrode 30. Ground electrode 30 is positioned adjacent to a firing center electrode 35 to define a firing gap 40. Firing center electrode 35 is electrically connected to a terminal 43. Splined installation section 20 includes castellations 45 and splines 50. Castellations 45 are recessed regions of outer shell 15 that define the splines 50. Each spline 50 includes a top edge 55, a pair of side edges 60, and an outer surface 63.

Figure 2:
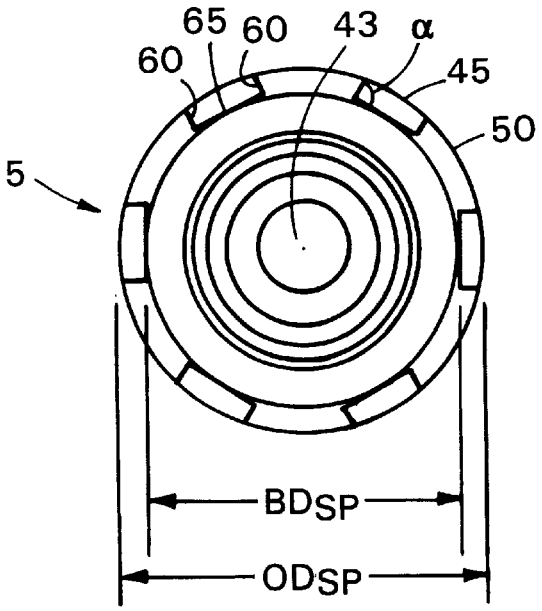
FIG. 2 is a top view of the spark plug of FIG. 1.

Referring also to FIG. 2, each castellation 45 is defined by a back surface 65 and a pair of side edges 60. Side edges 60 intersect back surface 65 to form an angle, $\alpha$. In general, the angle $\alpha$ is less than or equal to 90°. Castellations 45 are formed by machining away material from outer shell 15 using conventional machining techniques, and also may be formed during casting of outer shell 15. The angle a formed by the intersection of side edges 60 and back surface 65 may be varied by changing the dimensions of the cutting tool used to machine away the material. One or more castellations 45 may be machined in forming splined outer shell 15. However, operation of splines 50 is more effective when there are at least two castellations, and one implementation includes six castellations and corresponding splines. The outer shell may be made of a metal, such as steels, stainless steels, or nickels.

Insulator core assembly 10 and splined outer shell 15 may have dimensions comparable to those of a conventional spark plug. For example, splined section 20, which is the largest diameter portion of spark plug 5, may have an outer diameter, $OD_{SP}$, of 16 mm. Splined section 20 may have a base diameter, $BD_{SP}$, as measured between opposite back surfaces 65, of 14 mm.

Figure 3:
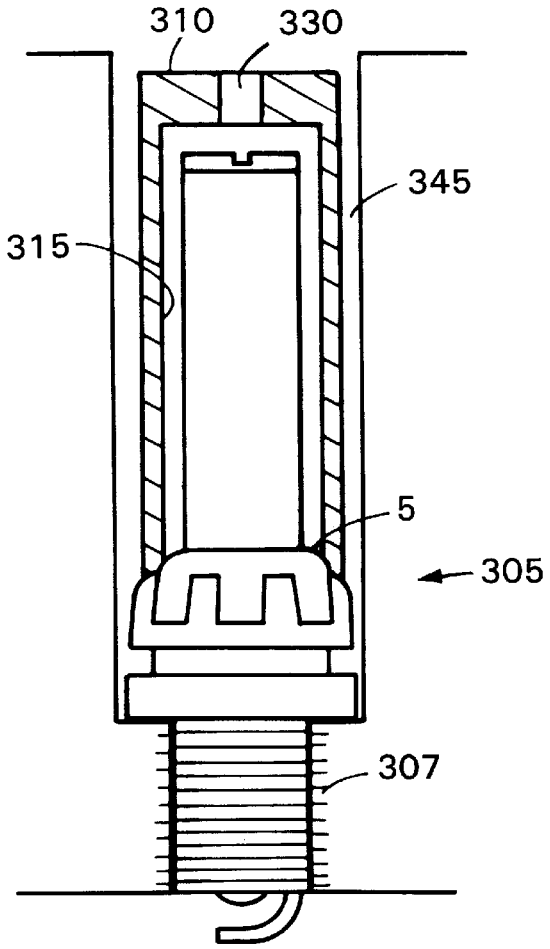
FIG. 3 is a cross sectional view of the spark plug of FIG. 1 installed in a combustion engine.
Figure 4:
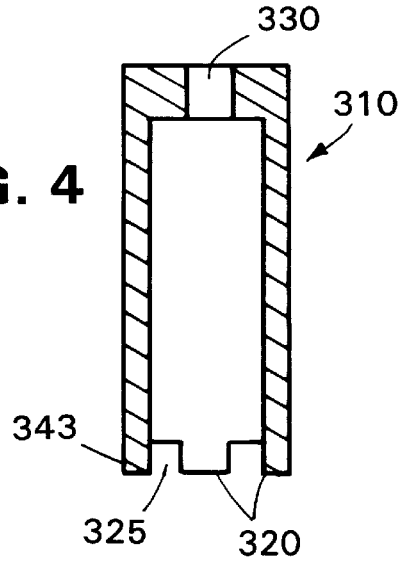
FIG. 4 is a cross sectional view of a splined socket.
Figure 5:
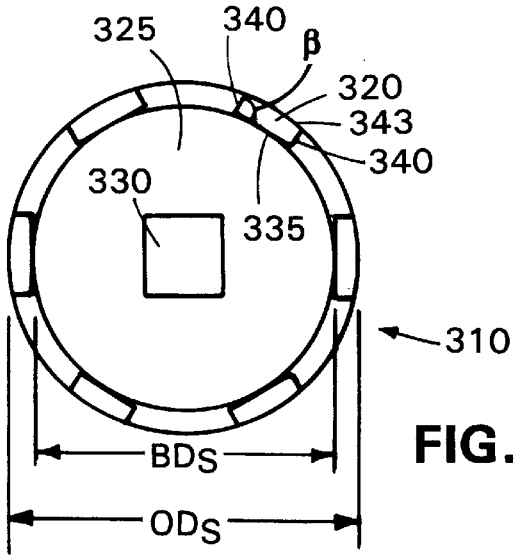
FIG. 5 is a top view of the splined socket of FIG. 4.

Referring to FIGS. 3–5, splined spark plug 5 is installed in a head 305 of a combustion engine (not shown) by threadably mounting plug 5 in a threaded section 307 of head 305 using a splined socket 310 and a socket wrench (not shown). Splined socket 310 includes a hollow shaft 315, socket splines 320, a first opening 325, and a second opening 330. Splines 320 are at one end of hollow shaft 315 and encircle first opening 325. They are shaped like castellations 45 of spark plug 5 but are smaller so that they can fit within castellations 45. Each spline 320 has an inner surface 335, a pair of edge surfaces 340, and an outer surface 343. Edge surfaces 340 intersect inner surface 335 to form an angle, β, which generally is 90° or less. The splines 320 may be made using conventional machining techniques to machine material away from the hollow shaft 315 to form the splines 320.

Second opening 330 is at the opposite end of hollow shaft 315 from first opening 325. Second opening 330 is configured to permit socket 310 to be connected to a socket wrench (not shown). For example, second opening 330 may have a square opening that can be connected to a socket wrench with a square head.

Splined socket 310 may have an outer diameter, $OD_S$, of 16 mm and a base diameter, $BD_S$, of 14 mm. As noted, each of the angles, α and β, associated with the spark plug castellations and the socket, respectively, are 90° or less. Thus, when splined socket 310 engages splined section 20, splines 320 fit within castellations 45 against side edges 60 (FIGS. 1 and 2). Side edges 60 have dual purposes. First, they provide a surface for socket 310 to engage against when threadably installing spark plug 5. Second, they secure socket splines 320 within castellations 45 by resisting slippage of the splines 320 out of the castellations 45. If angles α and β are each less than 90°, side edges 60 may be more effective in resisting slippage of the splines 320.

To threadably mount plug 5, plug 5 is inserted into a spark plug well 345 and splined socket 310 is placed over the insulator core assembly 10 until socket splines 320 are securely engaged within castellations 45. The socket wrench is then used to turn socket 310 to threadably install spark plug 5 in threaded section 307.

Other embodiments are within the scope of the following claims.

What is claimed is:

1. A spark plug comprising:

a ground electrode;

a firing electrode;

an insulator core; and an outer shell surrounding the insulator core and having a threaded section for mounting the spark plug in a combustion engine and a splined section for installation of the spark plug, wherein the splined section includes at least one spline having an outer surface and a corresponding castellation recessed from the outer surface, and wherein the threaded section has a first outer diameter and the splined section has a second, different outer diameter.

2. The spark plug of claim 1, wherein the castellation includes a back surface and a pair of edge surfaces.

3. The spark plug of claim 2, wherein the back surface is curved.

4. The spark plug of claim 2, wherein an intersection of an edge surface and the back surface defines an angle of 90° or less.

5. The spark plug of claim 4, wherein intersections of the edge surfaces and the back surface define angles of 90° or less.

6. The spark plug of claim 1, wherein the splined section includes at least two splines and two castellations.

7. The spark plug of claim 1, wherein the splined section includes six splines and six castellations.

8. The spark plug of claim 1, wherein a maximum outer diameter of the splined section, as measured from the outer surface of a spline, is approximately 16 mm.

9. The spark plug of claim 8, wherein a base diameter of the splined section is approximately 14 mm.

10. A splined socket for installing a splined spark plug, the splined socket including:

an opening;

at least one spline, the spline extending beyond the opening;

a structure for connecting the socket to a socket wrench; and a shaft extending between the opening and the structure.

11. The splined socket of claim 10, wherein the at least one spline extends from the shaft at the opening.

12. The splined socket of claim 10, wherein six splines extend from the shaft at the opening.

13. The splined socket of claim 10, wherein each spline includes an inner surface, an outer surface, and a pair of edge surfaces.

14. The splined socket of claim 13, wherein an intersection of an edge surface and the inner surface defines an angle of 90° or less.

15. The splined socket of claim 14, wherein intersections of the edge surfaces and the inner surface define angles of 90° or less.

16. The splined socket of claim 13, wherein a maximum outer diameter of the socket, measured from the outer surface of a spline, is approximately 16 mm.

17. A method of installing a spark plug having a splined installation section, the method comprising:

placing the spark plug in a spark plug well of a combustion engine;

placing a splined socket over the spark plug;

engaging the splined socket with the splined installation section of the spark plug; and threadably mounting the spark plug in a threaded section of a head of the combustion engine, wherein the splined socket has an opening and at least one spline extending beyond the opening, and the splined installation section of the spark plug has at least one spline and a corresponding recessed castellation.

18. The method of installing a spark plug of claim 17, wherein engaging the splined socket with the spark plug includes inserting the at least one spline of the splined socket into the at least one castellation of the splined installation section of the spark plug.

19. The method of installing a spark plug of claim 17, wherein the at least one castellation includes a back surface and a pair of edge surfaces.

20. The method of installing a spark plug of claim 17, wherein the splined section includes six splines and six castellations.

21. The method of installing a spark plug of claim 20, wherein a maximum outer diameter of the splined section, as measured between a pair of opposite outer surfaces of the splines, is approximately 16 mm.

22. The method of installing a spark plug of claim 21, wherein a base diameter of the splined section is approximately 14 mm.

23. The method of installing a spark plug of claim 17, wherein the splined socket includes:

at least one spline;

an opening;

a structure at an end opposite of the opening and configured for connection to a socket wrench; and a shaft passing between the opening and the structure.

24. The method of installing a spark plug of claim 23, wherein six splines extend from the shaft at the opening.

25. The spark plug of claim 1, wherein the splined section has a larger outer diameter than the outer diameter of the threaded section.

* * * * *